United States Patent [19]

Williamson, Jr.

[11] 4,429,747

[45] Feb. 7, 1984

[54] WELL TOOL

[75] Inventor: Jimmie R. Williamson, Jr., Carrollton, Tex.

[73] Assignee: Otis Engineering Corporation, Dallas, Tex.

[21] Appl. No.: 298,482

[22] Filed: Sep. 1, 1981

[51] Int. Cl.[3] ..... E21B 34/08

[52] U.S. Cl. ..... 166/321; 166/386

[58] Field of Search ..... 166/321, 318, 319, 332, 166/334, 386, 387, 183, 188, 194; 137/70, 155, 494

[56] References Cited

U.S. PATENT DOCUMENTS

| | | | |
|---|---|---|---|
| 3,051,243 | 8/1962 | Grimmer et al. | 166/332 |
| 3,193,016 | 7/1965 | Knox | 166/325 |
| 3,306,365 | 2/1967 | Kammerer, Jr. | 166/318 |

*Primary Examiner*—James A. Leppink
*Assistant Examiner*—Thuy M. Bui
*Attorney, Agent, or Firm*—Albert W. Carroll

[57] ABSTRACT

A ported sliding sleeve valve for use in a well tubing to provide a lateral flow path for transfer of fluids between the tubing and the annulus exterior thereof, the lateral ports of the device being initially closed by a port closure sleeve which is movable to port-opening position by increasing the annulus pressure to a level exceeding tubing pressure by a predetermined value, the port closure sleeve moving to fully open position upon being released and afterwards remaining in this position while the lateral ports of the device are thereafter opened and closed by shifting a built-in sliding sleeve valve through use of a shifting tool run and operated via wireline or pumpdown tools in a manner well known in the industry.

9 Claims, 7 Drawing Figures

WELL TOOL

BACKGROUND OF THE INVENTION

1. Field of the Invention

This invention relates to well tools and more particularly to ported sliding sleeve devices for controlling fluid communication between flow conductors in wells.

2. Description of the Prior Art

Well tools having lateral ports through their walls to provide fluid communication between their interiors and the regions exterior thereof and controlled by sliding sleeve valves slidable therein between port-opening and port-closing positions have been used for many years to provide a fluid communication path between, for instance, the tubing and the surrounding annulus so that treating or loading fluids could be circulated through the well for such purposes as treating or killing the well, or the like.

Examples of such sliding devices and related tools are found in the following U.S. patents.

| | | |
|---|---|---|
| 2,947,363 | 3,115,188 | 3,292,706 |
| 2,999,546 | 3,211,232 | 3,871,450 |
| 3,051,243 | 3,244,234 | |

U.S. Pat. No. 2,947,363 issued Aug. 2, 1960 to T. H. Sackett et al. and discloses a ported sliding sleeve device in which the sliding sleeve valve is initially in port-open position to provide a passage through the wall of the device for the transfer of fluids between the interior of the pipe string to the exterior thereof. The sleeve valve is moved to closed position by dropping a ball or the like into the conduit and allowing it to come to rest on the sliding sleeve, after which the conduit is pressurized to force the ball and sliding sleeve down to closed position where it is held thereafter by a deformed washer engaging serrations on the sleeve's exterior surface. The bore of the sliding sleeve is necessarily restricted.

U.S. Pat. No. 2,999,546 issued Sept. 12, 1961 to G. G. Grimmer et al. and discloses a sliding sleeve device connected in a main flwo conductor and having a lateral opening connected to a smaller conductor or barrel extending alongside it. Its sliding sleeve is connected to a sliding valve in the smaller conduit. When the sliding sleeve is shifted, the sliding valve in the outer conduit is shifted. In this manner, flow through the lateral ports of both conduits is controlled. The sliding sleeve is shiftable by a tool lowered through the main flow conductor.

U.S. Pat. No. 3,051,243 issued Aug. 28, 1962 to G. G. Grimmer et al. and discloses a ported sliding sleeve device connectable in a well flow conductor. A sliding sleeve valve inside is shiftable between positions in which it either closes or opens the lateral ports in the wall of the body to either allow or prohibit the passage of fluids through the lateral ports as for circulation between the tubing and the casing. The sliding sleeve is shifted by use of a shifting tool lowered into the tubing, as on a wire line, in the manner shown and described in the patent and well known in the industry.

The device of the present invention is an improvement over the device of U.S. Pat. No. 3,051,243, and this patent, together with U.S. Pat. No. 3,211,232 next to be discussed, is believed by applicant to be the most pertinent prior art with which he is familiar.

U.S. Pat. No. 3,211,232 issued Oct. 12, 1965 to G. G. Grimmer and discloses a device like that covered by U.S. Pat. No. 3,051,243 just discussed but with added features. This sliding sleeve initially has its lateral ports closed by pump-out plugs 43 which can be expelled by applying a predetermined high pressure thereto through the tubing. The sliding sleeve is initially in open position, and a shifting device 130, 140 is locked therein. During completion of the well, the pump-out plugs prevent communication through the lateral ports so long as the pressure in the tubing does not exceed that exterior thereof by an appreciable amount. The pressure exterior of the tubing can be much higher than that inside without consequence since the pump-out plugs are supported against inward movement. When it is desired to circulate fluids through the lateral ports, the pressure in the tubing is increased until one or more of the pump-out plugs move outwardly, breaking the band or wire 48 which surrounds the device to retain these plugs in place. There are usually four of these plugs, but it has been common experience for less than the total number to be expelled because once one, or two, or three of them are expelled, the differential pressure may be so reduced that the remaining plug(s) cannot be expelled. Further, one or two of the pump-out plugs could be so close to the inner wall of the casing that they cannot be expelled. This could easily happen in crooked or deviated well bores where the tubing may lean against the wall of the surrounding casing. When it is desired to shift the sliding sleeve closed, a ball or plug is dropped down the tubing bore and allowed to settle atop the shifting device, thus plugging the bore through the shifting device. Pressure is then increased above the ball or plug, and the sleeve valve is forced down to closed position. The plug and shifting device are in this manner expelled and dropped to the bottom of the well. The pump-out plugs withstand considerable pressures from exterior of the tubing, but are responsive to and are expelled only by pressure within the tubing.

U.S. Pat. No. 3,244,234 issued to D. H. Flickinger on Apr. 5, 1966 and discloses a sliding sleeve device having a ported body and a sleeve controlling flow through the ports. In each of the two forms shown and described, the sleeve valve is moved to open position responsive to high exterior pressure. In one form the sleeve valve is inside the body and is spring biased toward closed position. In the other form, the sleeve valve surrounds the body. Both of these embodiments permit inward flow but prevent outward flow.

U.S. Pat. No. 3,292,706 issued to G. G. Grimmer et al. on Dec. 20, 1966 and discloses a well safety device utilizing a sliding sleeve device which admits annulus pressure to a safety valve mounted within the tubing. When the annulus pressure becomes excessive, the safety valve closes. The differential pressure which then develops across the closed safety valve in the tubing and moves the sliding sleeve valve to closed position to shut off communication from the annulus to the safety valve.

U.S. Pat. No. 3,871,450 issued to Marion B. Jett et al. on Mar. 18, 1975 and discloses a sliding sleeve device in which the sliding sleeve means surrounds dual side-by-side mandrels connectable to dual parallel tubing strings. A port in each mandrel communicates with a different variable-volume pressure chamber formed between the exterior of the mandrels and the interior of the sliding sleeve means. Pressuring one mandrel causes the sleeve to open the lateral flow ports and pressuring the other mandrel causes the sleeve to move to its closed position.

U.S. Pat. No. 3,115,188 issued Dec. 24, 1963 to C. B. Cochran et al. and discloses a sliding sleeve device and shifting tool therefor similar to that disclosed in U.S. Pat. No. 3,051,243 to Grimmer et al. discussed previously.

None of the prior art known to applicant shows a sliding sleeve device which can be installed in a well with its main sleeve valve in open position and has its lateral flow ports initially closed by means responsive to casing pressure but not to tubing pressure, and after the ports are opened by a predetermined high casing pressure, the closure is held in port-opening position.

The present invention overcomes at least some of the problems and shortcomings associated with ported well tools in which the ports are controlled by sliding sleeve valves which are shifted for the most part by shifting tools lowered thereto through the tubing. By providing a port closure responsive to casing pressure, high tubing pressures can be utilized in completing the well. Such a closure saves a trip into the well with a shifting tool and thus saves rig time and money. And, since the closure, once it is opened, is held in open position, it cannot at a later time interfere with flow through the flow ports. Further, since the port closure is inside the body, the casing wall cannot interfere with its operation. Additionally, the closure is protected during its trip into the well because it is completely enclosed within the body.

SUMMARY OF THE INVENTION

The present invention is directed to a well tool for controlling fluid communication through the wall of a flow conductor in a well, this well tool having an elongate body with lateral ports through its wall and connecting means on its ends for attachment to a well flow conductor to become a part thereof, a first sleeve valve mounted for limited sliding movement in the body and movable between positions opening and closing the lateral ports, this first sleeve valve having means thereon engageable by a shifting tool for movement between open and closed positions, and a second sleeve valve between the body and the first sleeve valve initially closing the lateral ports but movable to a position openin such ports in response to a predetermined high pressure at the lateral ports, that is, exterior of the well tool.

It is an object of this invention to provide a well tool having one or more lateral communication ports through the wall thereof to allow circulation of fluids between flow conductors in a well.

Another object of this invention is to provide a well tool of the character described having a first sleeve valve movable therein between positions opening and closing the lateral ports.

A further object is to provide such a well tool wherein the first sleeve valve has means thereon adapted to be engaged by a shifting tool for movement of the first sleeve valve between its open and closed positions.

Another object is to provide a device of the character set forth having a second sleeve valve, which second valve is placed between the body and the first sleeve valve and is initially releasably secured in a position closing the lateral ports and movable to a position opening the lateral ports.

Another object of this invention is to provide such a well tool in which the second sleeve valve is movable from its initially closed position to its open position in response to the pressure of the fluid in the lateral ports and acting on the exterior surface of the second sleeve valve reaching a predetermined high value.

A further object is to provide such a well tool in which the second sleeve valve upon being moved to open position is thereafter held in such position so that flow through the lateral ports is thereafter controllable by the first sleeve valve without interference from the second sleeve valve.

Other objects and advantages will become apparent from reading the description which follows and from studying the accompanying drawing wherein:

DESCRIPTION OF THE PREFERRED EMBODIMENT

Figure 1A:
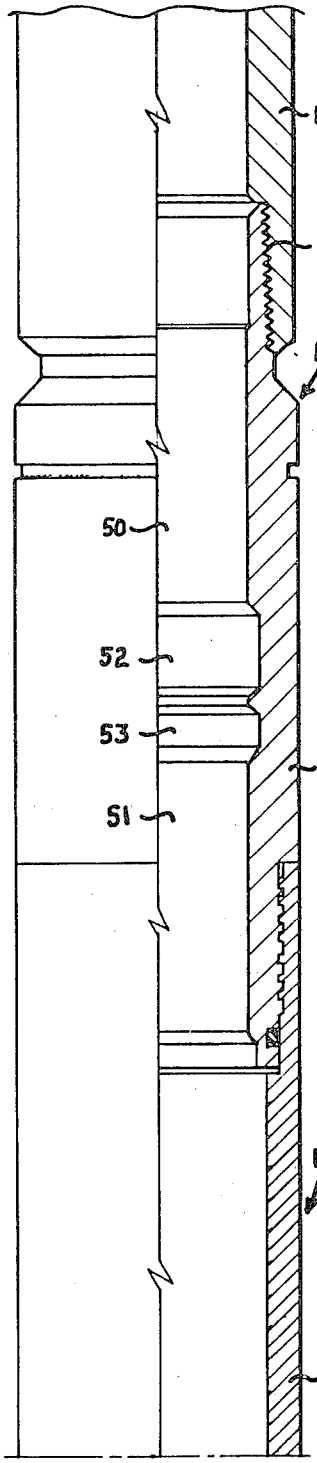
FIGS. 1A, 1B, and 1C, taken together, form a longitudinal view partly in section and partly in elevation showing the upper, intermediate, and lower portions, respectively, of a well tool constructed in accordance with the present invention with its first sleeve valve open and its second sleeve valve closed.

Referring now to FIGS. 1A–3, it will be seen that the device of this invention is indicated generally by the numeral 10. It comprises a housing 11 which includes upper sub 12, intermediate sub 13, ported sub 14, and lower sub 15 threadedly connected together as shown. The upper and lower ends of the housing 11 are provided with threads 17 and 18 for attachment to upper and lower portions 19 and 20 of a well flow conductor such as a well tubing string. The ported sleeve 14 is provided with a plurality of lateral ports 22 which communicate the interior of the sleeve with the exterior thereof and thus provide a path for transfer or circulation of fluids between the interior of the well tubing and the exterior thereof.

A sliding sleeve valve 24 is slidably disposed within the housing 11 and is movable longitudinally therein between upper, intermediate, and lower positions. Through slots 26 near the upper end of the sliding sleeve valve 24 are alignable with the ports 22 of the housing when the sliding sleeve valve is in its lower position shown in FIGS. 1B and 1C. When the sliding sleeve valve is in its upper position shown in FIG. 5, the slots 26 thereof are not aligned with the ports 22 of the housing. Suitable packing sets are disposed between the sliding sleeve valve and the housing to direct flow through the ports of the housing and to prevent flow between the exterior of the sleeve and the interior of the housing. The upper set of packing 28 seals between the sliding sleeve valve and the housing at a location spaced above the lateral ports 22 of the housing while a similar packing set 29 seals between the sliding sleeve valve and the housing at a point spaced considerably below the lateral ports 22 of the housing.

Figure 1B:
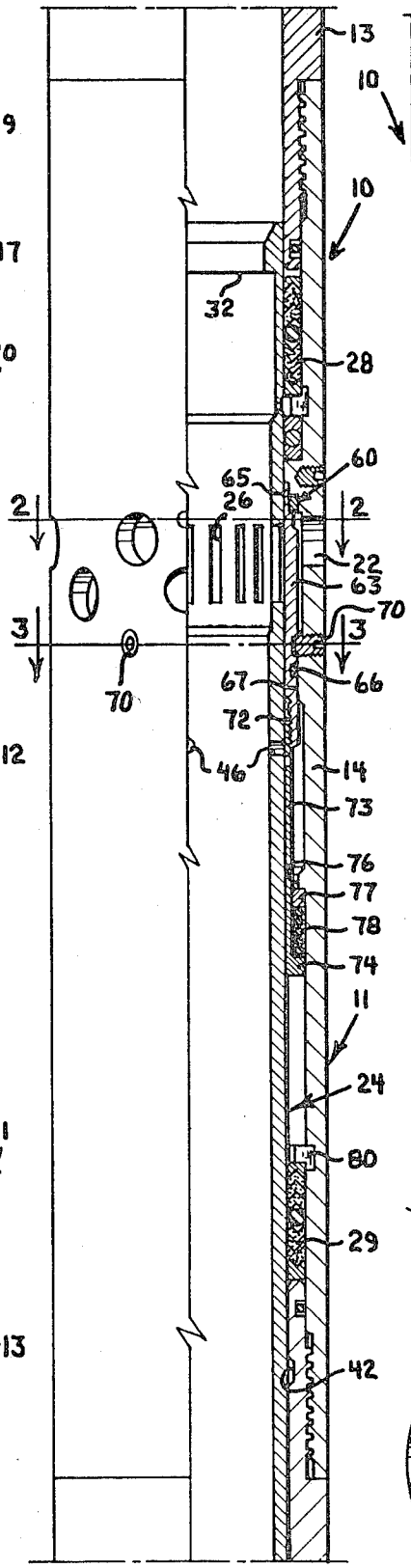
Figure 1C:
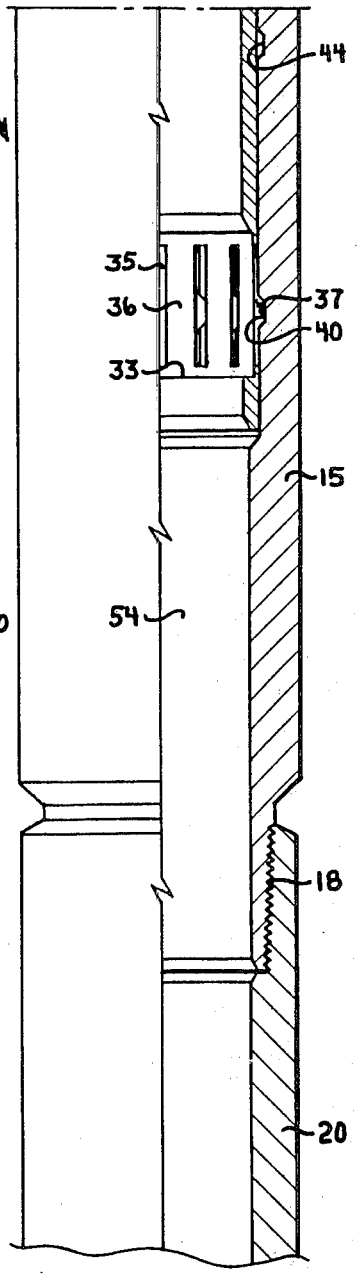
Figure 2:
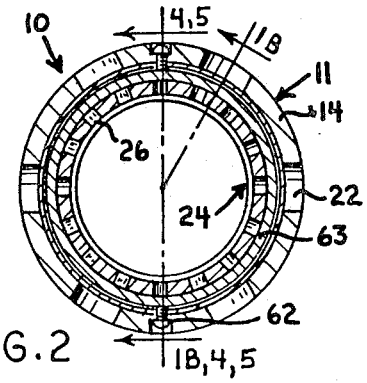
FIG. 2 is a cross-sectional view taken along line 2—2 of FIG. 1B.
Figure 3:
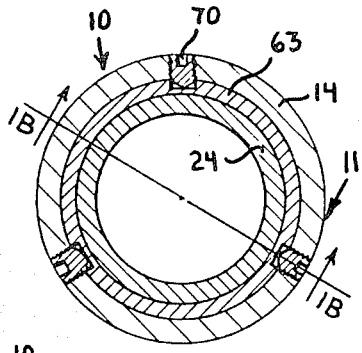
FIG. 3 is a cross-sectional view taken along line 3—3 of FIG. 1B.
Figure 5:
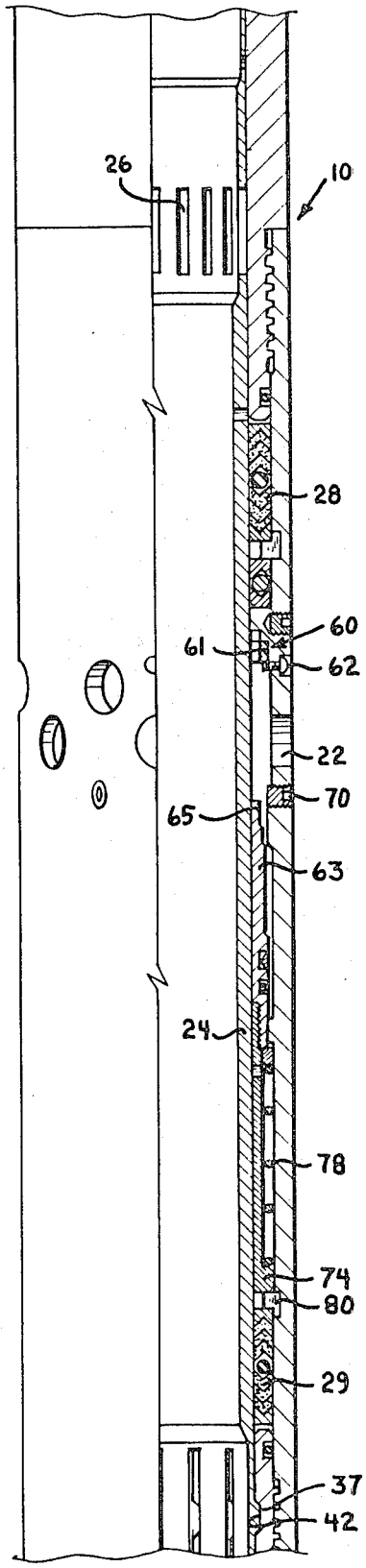
FIG. 5 is a view similar to FIG. 4 showing the device of FIG. 4 with its first sleeve valve shifted to closed position and its second sleeve valve held in its open position.

The sliding sleeve valve is provided with an internal annular downwardly facing shoulder 32 near its upper end and with a similar upwardly facing shoulder 33 near its lower end for engagement by a suitable shifting tool by which the sleeve valve is positioned within the housing to control flow through the lateral ports 22 of the housing. Just above the upwardly facing shoulder 33 near the lower end of the sliding sleeve valve, a plurality of longitudinal slots 35 provides fingers therebetween forming a closed collet. These collet fingers 36 each have a boss 37 extended outwardly therefrom as shown, and these bosses have outwardly convergent upper and lower sides or cam surfaces. The bosses 37 are engageable in internal annular recesses formed in the lower sub 15 for the purpose of retaining the sliding sleeve valve in its proper position. For instance, the bosses 37 of the collet fingers 36 are engaged in the internal annular recess 40 of the lower sub 15 when the sliding sleeve valve 24 is in its lower position as shown in FIGS. 1B and 1C. In a similar manner, the bosses 37 of the collet fingers 36 will be engaged in the internal annular recess 42 of the lower sub when the sliding sleeve valve is in its upper position as shown in FIG. 5. In moving the sliding sleeve valve from its closed position, shown in FIG. 5, to its open position, shown in FIGS. 1B and 1C, the sliding sleeve valve should be stopped with the bosses 37 of the collet fingers 36 in engagement with the intermediate internal recess 44 in which position the equalizing port 46 of the sliding sleeve valve will be aligned with the lateral ports 22 of the housing allowing pressures internally and externally of the device to equalize. After such pressures have been equalized, the sliding sleeve valve 24 is then moved to its full open position shown in FIGS. 1B and 1C.

The features just described with respect to the drawings are well known and are shown in U.S. Pat. No. 3,051,243 to Grimmer et al. Such devices have been in use for many years. In addition, the upper sub 12 of FIG. 1A is provided with suitably prepared bore surfaces at 50 and 51 and with suitable internal annular lock recesses at 52 and 53, and at the same time the lower sub 15 is provided with a suitably prepared bore surface as at 54 for the purpose of receiving a suitable peak-off device or other tool in locking and sealing relationship with ported well tool 10 in order to control or prevent flow through the lateral ports 22 of the housing. Ported sliding sleeve devices having such bore surfaces and lock recesses are well known and have been used for many years. Such devices are shown in the Composite Catalog of Oil Field Equipment and Services-1970–71 Edition at page 3838, the devices shown on that page being available from Otis Engineering Corporation, Dallas, Texas.

Insofar as this present application is concerned, the sliding sleeve of the device illustrated and described herein operates in a manner similar to that of the device illustrated and described in the U.S. Pat. No. 3,051,243 to Grimmer et al. and the device illustrated in the aforementioned catalog, and the sliding sleeve is shifted between its longitudinal positions by a shifting tool like or similar to that illustrated and described in the Grimmer U.S. Pat. No. 3,051,243. A very similar shifting tool is illustrated on page 3839 of the catalog mentioned above.

In U.S. Pat. No. 3,211,232 Grimmer teaches the use of pump-out plugs for closing the lateral ports of the housing and also teaches the shifting of the sliding sleeve valve by dropping a plug into the tubing at the surface and then using fluid pressure thereabove to move the sliding sleeve to closed position. The present invention is similar to but is an improvement over the devices of Grimmer and Grimmer et al., just mentioned, with respect to U.S. Pat. Nos. 3,051,243 and 3,211,232 which are incorporated herein, together with the other patents mentioned hereinabove, for all purposes.

The well tool or sliding sleeve device 10 illustrated in the drawing embodies the present invention as will now be described.

The ported sleeve 14 which makes up a portion of the housing 11 of sliding sleeve device 10 is provided with a stepped bore immediately above the lateral ports 22, and a suitable annular resilient seal ring 60 fits closely in bore 61, as shown, and this seal ring 60 is held in the position shown by a plurality of screws 62 threaded through the wall of the ported sleeve 14 with their inner ends projecting inside to support the seal ring 60 against displacement from its proper position (shown). A port closure sleeve 63 surrounds the sliding sleeve valve 24 and has its upper reduced end portion 65 engaged within the seal ring 60 as shown in FIG. 1B. The port closure sleeve 63 carries a suitable annular seal ring such as the o-ring 66 in a suitable external annular recess, and this o-ring sealingly engages the bore wall 67 of the ported sleeve 14, as shown, so that the port closure sleeve 63 effectively seals the ports 22 of the ported sleeve. Fluid pressure entering through the ports 22 cannot pass around either end of the sleeve because of the seal rings 62 and 66 which are sealingly engaged between the port closure sleeve and the inner wall of the ported sleeve. It should be noticed, however, that the area within the circle of sealing contact between the upper end of the port closure sleeve 63 and the inner surface of the seal ring 60 is somewhat smaller than that area within the sealing circle defined by the bore wall 67 of the ported sleeve which is engaged by the seal ring 66. This area difference is exposed to tubing pressure from the inside and pressure exterior of the tubing from the outside. Thus when the pressure exterior of the well tool 10 exceeds the pressure within the tubing bore, there will be a tendency for this differential pressure to move the port closure sleeve downwardly to its open position.

The port closure sleeve 63 is provided with an external annular recess or a dimple, as desired, in which is engaged the inner end of one or more frangible shear screw 70 which is threaded through the wall of the ported sleeve 14 to lock the port closure sleeve 63 in the closed position as shown in in FIG. 1B. When the port closure sleeve 63 is thus closed, fluids may not pass or be transferred through the lateral ports 22 of the ported sleeve 14 regardless of the position of the sliding sleeve valve 24 therewithin. It will be noted in FIG. 1B that the sliding sleeve valve 24 is in its lower open position with its ports 26 aligned with the lateral ports 22 of the ported sleeve, but fluids cannot pass through the lateral ports 22 because the port closure sleeve 63 is, as yet, in its closed position.

The lower end of the port closure sleeve is threaded as at 72, and a sleeve 73 having an external flange 74 thereon is threadedly attached to the port closure sleeve as shown. The ported sleeve 14 has an internal annular flange 76 therein, and a ring or split-ring 77 surrounds the sleeve 73 and is lodged against the lower side of internal flange 76 while a coiled compression spring 78 surrounds the sleeve 73 and is confined between the ring 77 and the flange 74 just mentioned. The spring 78 thus applies a constant bias to the sleeve 73 and the port closure sleeve 63 attached thereto, tending to bias the port closure sleeve downwardly to its open position, but this sleeve is, as yet, still securely held in its closed position by the screws 70 described earlier.

After the sliding sleeve device 10 has been installed in a well and it is desired to circulate or transfer fluids therethrough, as by pumping fluids from the tubing into the casing or vice versa, the pressure in the tubing-casing annulus is increased above the well packer (not shown). When this pressure reaches a predetermined value, which value is higher than the value of the pressure within the tubing by a predetermined amount, this differential pressure acting on the difference between the areas sealed by the seal rings 60 and 66 applies sufficient downward force to the port closure sleeve 63 to shear the screws 70 and move the port closure sleeve downwardly, thus opening or uncovering the ports 22 in the ported sleeve 14. As soon as the screws 70 are sheared, the spring 78 expands, and the energy stored in the spring is sufficient to move the port closure sleeve 63 downwardly to its fully open position wherein the lower end of sleeve 73 comes to rest against the upper side of the split-ring 80 which forms a stop for the upper side of the packing set 29. The open position of the port closure sleeve is clearly shown in FIG. 4.

Figure 4:
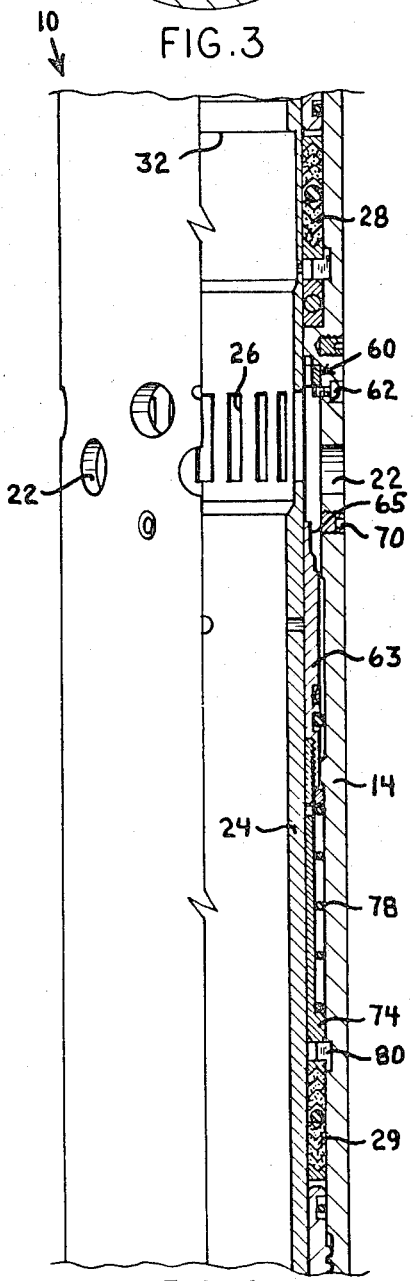
FIG. 4 is a longitudinal sectional view showing an intermediate portion of the device of FIGS. 1A, 1B, 1C with both its first and second sleeve valves open.

It will be seen in FIG. 4 that the port closure sleeve 63 is in its lowermost position, that its upper end is clear of the lateral ports 22 of the ported sleeve 14, that the sliding sleeve valve 24 therewithin is still in its lower open position, that the ports of the sliding sleeve valve are aligned with the lateral ports 22, and that circulation between the tubing and the exterior thereof, that is, the tubing-casing annulus can take place freely.

The spring 78 will maintain a downward bias on the sleeve 73 and will hold the port closure sleeve 63 in its lower position, shown in FIG. 4, and will not allow it to move upwardly where it might interfere with the circulation of fluids through the ports 22.

Thus, the port closure sleeve 63 which initially closed the lateral ports 22 of the device has been moved to its open position by the application of fluid pressure to the tubing-casing annulus, and it was not necessary to run any sort of tool into the well either by wireline, cable, or by pumpdown methods, and that once the ports 22 have been opened, they will remain open until the main sliding sleeve valve 24 is shifted to closed position.

To close the ports 22 of the ported sleeve 14 again in order to isolate the tubing-casing annulus from the tubing bore, a suitable shifting tool such as that illustrated in U.S. Pat. No. 3,051,243 to Grimmer et al. is run into the well by some suitable means such as by wireline, and the keys thereon are engaged with the downwardly facing shoulder 32 near the upper end of the sliding sleeve valve, and an upward force is applied thereto to slide the sliding sleeve valve from the lower position shown in FIGS. 1B and 1C to the closed position shown in FIG. 5.

In FIG. 5 it will be readily seen that an imperforate section of the sliding sleeve valve 24 now bridges the lateral ports 22 of the ported sleeve 14, and that this imperforate portion of the sliding sleeve valve is engaged within the upper and lower packing sets 28 and 29 so that fluid pressure entering through the lateral ports 22 cannot get into the tubing because such fluid pressure is confined between the two packing sets just mentioned.

If it is desired to again open the lateral ports 22, the same shifting tool that was used to shift the sleeve upwardly can be inverted as taught in the aforementioned U.S. Pat. No. 3,051,243 and run into the tubing string again until the keys thereof engage upward facing shoulder 33 at the lower end of the sliding sleeve valve 24 and a downward force is applied thereto to slide the sliding sleeve valve downwardly from its upper position shown in FIGS. 1B and 1C to its closed position shown in FIG. 4, in which position its slots 26 are aligned with the lateral ports 22. Since the port closure sleeve 63 remains held down out of the way by spring 78, as shown in FIG. 4, circulation of fluids between the tubing and its exterior may take place freely through the slots 26 and the ports 22.

In operation, when it comes time to complete a well which has just been drilled, and a string of casing has been placed in the well bore to extend from the surface downwardly to or past the production formation, the well is further equipped by running a string of tubing thereinto, the string of tubing having a packer near its lower end, to lock the tubing to the casing and seal therebetween at a location immediately above the producing formation. The casing may be perforated at the producing formation either before or after the tubing is run into the well. A sliding sleeve device such as that illustrated in FIGS. 1A-5 may be included in the tubing string a short distance above the packer. At the time that the packer is set, the tubing and casing both will be full of weighted fluid such as mud in order to maintain the producing formation under control. After the packer is set, the pressure of the mud in the tubing-casing annulus is increased to test the packer, then the annulus pressure is further increased to open the sliding sleeve device by applying a downward pressure to the port closure sleeve 63 to shear the screws 70 so that the port closure sleeve 63 can be moved to its fully open position by the spring 78. This opens the lateral ports 22 of the well tool so that a lighter medium such as water or oil may be used to displace the mud from the tubing by pumping it down the tubing and forcing the mud outwardly through the lateral ports 22 into the annulus where it rises to the surface. In many cases it is desirable to close the sliding sleeve valve 24 as soon as the mud is displaced from the tubing so that the mud will remain in the tubing-casing annulus and the water will remain in the tubing string. Now, if the producing formation is of abnormal bottom hole pressure, it is only then necessary to open the well up and let it come in or flow. However, if the bottom hole pressure is not sufficient to lift the water, then it may be necessary to swab the well or use other means to unload the well of the water and permit the well products to flow.

It is readily understood that one advantage of the device just described is that the ports 22 are initially closed but can be opened by application of mud pressure to the annulus, thus making it unnecessary to run tools or drop plugs into the tubing at this time when the tubing is full of mud. Tools do not fall through the mud readily, nor do they operate as efficiently in mud as compared to water or oil. It is further understood that after the mud pressure has caused the ports 22 to open and the mud is displaced from the tubing through the ports 22, the shifting tool may be run into the well, the tubing now filled with water, and its work easily accomplished since these tools work much better in water than they do in mud. In this manner, much time and expense is saved, and this could be considerable in view of the fact that many wells are now being drilled offshore from expensive platforms or expensive drill ships or semi-submersible structures where operations run into the thousands of dollars per hour. Also, most such wells have deviated bores making it even more desirable to have water or oil in the tubing when carrying on tool operations therein.

Thus it has been shown that the device of this invention accomplishes all of the objects set forth in the beginning of this application and that changes in the sizes and the shapes of the parts and the arrangements thereof may be had by those skilled in the art without deparing from the true spirit of this invention.

I claim:

1. A well tool, comprising:

a. an elongate tubular body having means on its opposite ends for attachment to a well flow conductor and having lateral port means intermediate its ends fluidly communicating its interior with the exterior thereof;

b. first sleeve valve means in said tubular body slidable between positions opening and closing said lateral port means;

c. second sleeve valve means in said tubular body surrounding said first sleeve means and initially closing said lateral port means, said second sleeve valve means being movable to a position opening said lateral port means in response to a predetermined high pressure from exterior of said tubular body; and d. seal means initially sealingly engaged between said tubular body and said second sleeve valve means to prevent leakage of fluids between the interior and exterior of said body through said lateral port means.

2. The device of claim 1, including releasable means retaining said second sleeve in initial closed position, said releasable means releasing said second sleeve valve means for movement to open position when pressure exterior thereof reaches a predetermined high value.

3. The device of claim 2, wherein said means retaining said second sleeve valve in initial closed position is at least one frangible member engaged between said second sleeve valve and said tubular body, said frangible member fracturing and releasing said second sleeve valve means for movement to open position when the pressure exterior thereof reaches a predetermined value.

4. The device of claim 3, wherein said at least one frangible member is a shear screw threaded into one and having a portion thereof engageable in recess means on the other of said tubular body and said second sleeve valve means.

5. The device of claim 1, 2, 3, or 4, wherein said seal means for sealing between said tubular body and said sleeve valve include:

a. first seal means sealing between said tubular body and said second sleeve valve means on one side of said lateral port means and spaced longitudinally therefrom; and b. second seal means sealing between said tubular body and said second sleeve valve means on the opposite side of said lateral port means and spaced longitudinally therefrom, said second seal means sealing an area larger than that area sealed by said first seal means, the difference between these two areas being subjected to pressures interior of the tubing and exterior thereof, the force resulting from the difference in these pressures acting on the difference in these areas becoming effective to move said second sleeve valve means to open position when said pressure exterior of said tubing exceeds said pressure within said tubing by a predetermined value.

6. The device of claim 5, wherein:

a. said first seal means is carried in said tubular body and is initially engaged with a seal surface provided on the exterior of said second sleeve valve means; and b. said second seal means is carried on said second sleeve valve means and is initially engaged with a seal surface formed in said tubular body.

7. The device of claim 6, including:

a. internal shoulder means in said tubular body;

b. abutment means on said second sleeve valve means; and c. biasing means engaged between said shoulder means in said body and said abutment means on said second sleeve valve means to aid in moving said second sleeve valve means to open position.

8. The device of claim 7, wherein said second sleeve valve means is held in open position by said biasing means after it has been moved to open position.

9. The device of claim 8, wherein said biasing means is a coil spring.

* * * * *